US010847896B2

(12) United States Patent
Liu

(10) Patent No.: US 10,847,896 B2
(45) Date of Patent: Nov. 24, 2020

(54) ANTENNA ARRAY SYSTEM

(71) Applicant: ACCTON TECHNOLOGY CORPORATION, Hsinchu (TW)

(72) Inventor: I-Ru Liu, Taipei (TW)

(73) Assignee: ACCTON TECHNOLOGY CORPORATION, Hsinchu (TW)

( * ) Notice: Subject to any disclaimer, the term of this patent is extended or adjusted under 35 U.S.C. 154(b) by 18 days.

(21) Appl. No.: 16/377,269

(22) Filed: Apr. 8, 2019

(65) Prior Publication Data

US 2019/0356056 A1 Nov. 21, 2019

(30) Foreign Application Priority Data

May 15, 2018 (TW) ..... 107206338 U

(51) Int. Cl.
*H01Q 3/44* (2006.01)
*H01Q 21/06* (2006.01)

(52) U.S. Cl.
CPC ..... *H01Q 21/061* (2013.01); *H01Q 3/44* (2013.01)

(58) Field of Classification Search
CPC ..... H01Q 21/061; H01Q 3/44
See application file for complete search history.

(56) References Cited

U.S. PATENT DOCUMENTS

| | | | | |
|---|---|---|---|---|
| 9,379,873 | B2 | 6/2016 | Kang et al. | |
| 2014/0159978 | A1* | 6/2014 | Gottl | H01Q 21/26 343/817 |
| 2016/0105228 | A1* | 4/2016 | Cook | H01Q 21/28 370/329 |

* cited by examiner

*Primary Examiner* — Graham P Smith
(74) *Attorney, Agent, or Firm* — CKC & Partners Co., LLC

(57) ABSTRACT

The present disclosure provides an antenna array system that includes a plurality of antenna array units and a processor. The antenna array units are evenly arranged in different orientations, where each antenna array unit comprises a plurality of antenna elements with different azimuth angles, and the different azimuth angles of the antenna elements in the each antenna array unit form a vector, where the vectors corresponding to the antenna array units constitute a vector matrix that matches a predetermined rule. The processor is electrically connected to the antenna array units.

10 Claims, 6 Drawing Sheets

ANTENNA ARRAY SYSTEM

RELATED APPLICATIONS

This application claims priority to Taiwanese Patent Application No. 107206338, filed May 15, 2018, the entirety of which is herein incorporated by reference.

BACKGROUND

Field of Invention

The present disclosure relates to antenna structure, and more particularly, an antenna array system.

Description of Related Art

Multiple-input and multiple-output (MIMO) is an abstract mathematical model used to describe multi-antenna wireless communication systems. The MIMO can independently transmit signals by using multiple antennas at the transmitting end, and receive information by using multiple antennas at the receiving end.

However, in the conventional multi-antenna wireless communication system, the antennas are mostly oriented in the same direction, which result in the directionality limitation. Therefore, the conventional multi-antenna wireless communication system is difficult to operate in a complicated environment of many people.

In view of the foregoing, there exist problems and disadvantages in the current technology, and further improvements are required for those ordinarily skilled in the art to solve the above-mentioned problems. For the forgoing reasons, there is a need for improving the diversity of angles of the antennas.

SUMMARY

The following presents a simplified summary of the disclosure in order to provide a basic understanding to the reader. This summary is not an extensive overview of the disclosure and it does not identify key/critical elements of the present invention or delineate the scope of the present invention. Its sole purpose is to present some concepts disclosed herein in a simplified form as a prelude to the more detailed description that is presented later.

In one or more various aspects, the present disclosure is directed to an antenna array system to solve the problems in the prior art.

An embodiment of the present disclosure is related to an antenna array system that includes a plurality of antenna array units and a processor. The antenna array units are evenly arranged in different orientations, where each antenna array unit includes a plurality of antenna elements with different azimuth angles, and the different azimuth angles of the corresponding antenna elements in the each antenna array unit form a vector, where the vectors corresponding to the antenna array units constitute a vector matrix that matches a predetermined rule. The processor is electrically connected to the antenna array units.

In one embodiment, each azimuthal difference between any adjacent two of the antenna elements in the each antenna array unit is identical in value, and each azimuthal difference between two corresponding antenna elements of any adjacent two of the antenna array units is identical in value.

In one embodiment, the number of the antenna array units is four, there are four sets of the vectors, and the vector matrix is a 2×2 vector matrix, and the predetermined rule comprises that each difference between two vector heads of any two adjacent vectors of the four sets of the vectors is identical in value.

In one embodiment, the number of the antenna array units is nine or sixteen, so there are nine sets of the vectors when the number of the antenna array units is nine. Moreover, there are sixteen sets of the vectors when the number of the antenna array units is sixteen. The vector matrix of the nine sets of the vectors is a 3×3 vector matrix, and the vector matrix of the sixteen sets of the vectors is a 4×4 vector matrix. The predetermined rule includes that the sum of each row, column and diagonal of RMS (Root mean square) values of the vectors in the vector matrix is substantially equal.

In one embodiment, vector heads are selected from the vectors in the vector matrix to constitute a head matrix, and the predetermined rule comprises that the sum of each row, column and diagonal of values of the head matrix is substantially equal.

In one embodiment, vector heads are selected from the vectors in the vector matrix as selected values to constitute a head matrix. The selected values of the head matrix are simplified to be index integers to constitute an index matrix, wherein the order of the index integers depends on the magnitude of the selected values, and the predetermined rule comprises that the sum of each row, column and diagonal of values of index integers of the index matrix is substantially equal.

In one embodiment, the 3×3 vector matrix matches the predetermined rule, any row and any column of the 3×3 vector matrix have a plurality of azimuth clustered sets respectively, each azimuth clustered set corresponds to a set of antenna elements, and the set of antenna elements are electrically connected to each other, so as to facilitate operation by the processor.

In one embodiment, the antenna array system further includes a plurality of virtual loads, a plurality of wireless transceivers, first conducting wires and second conducting wires. The wireless transceiver units are electrically connected to the processor. Two ends of each of the first conducting wires are electrically connected to a corresponding one of antenna array units and a corresponding one of virtual loads. The second conducting wires are interlaced with the first conducting wires, where two ends of each of the second conducting wires are electrically connected to a corresponding one of the wireless transceiver units and a ground.

In one embodiment, the antenna array system further includes electronic switches. Each of the electronic switches is electrically connected to the corresponding one of the first conducting wires and the corresponding one of the second conducting wires.

In one embodiment, the each of the electronic switches is a diode, an anode of the diode is electrically connected to the corresponding one of the first conducting wires, and a cathode of the diode is electrically connected to the corresponding one of the second conducting wires.

Technical advantages are generally achieved, by embodiments of the present disclosure. The antenna array system of the present disclosure can improve the diversity of angles of the antennas.

Many of the attendant features will be more readily appreciated, as the same becomes better understood by reference to the following detailed description considered in connection with the accompanying drawings.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1A:
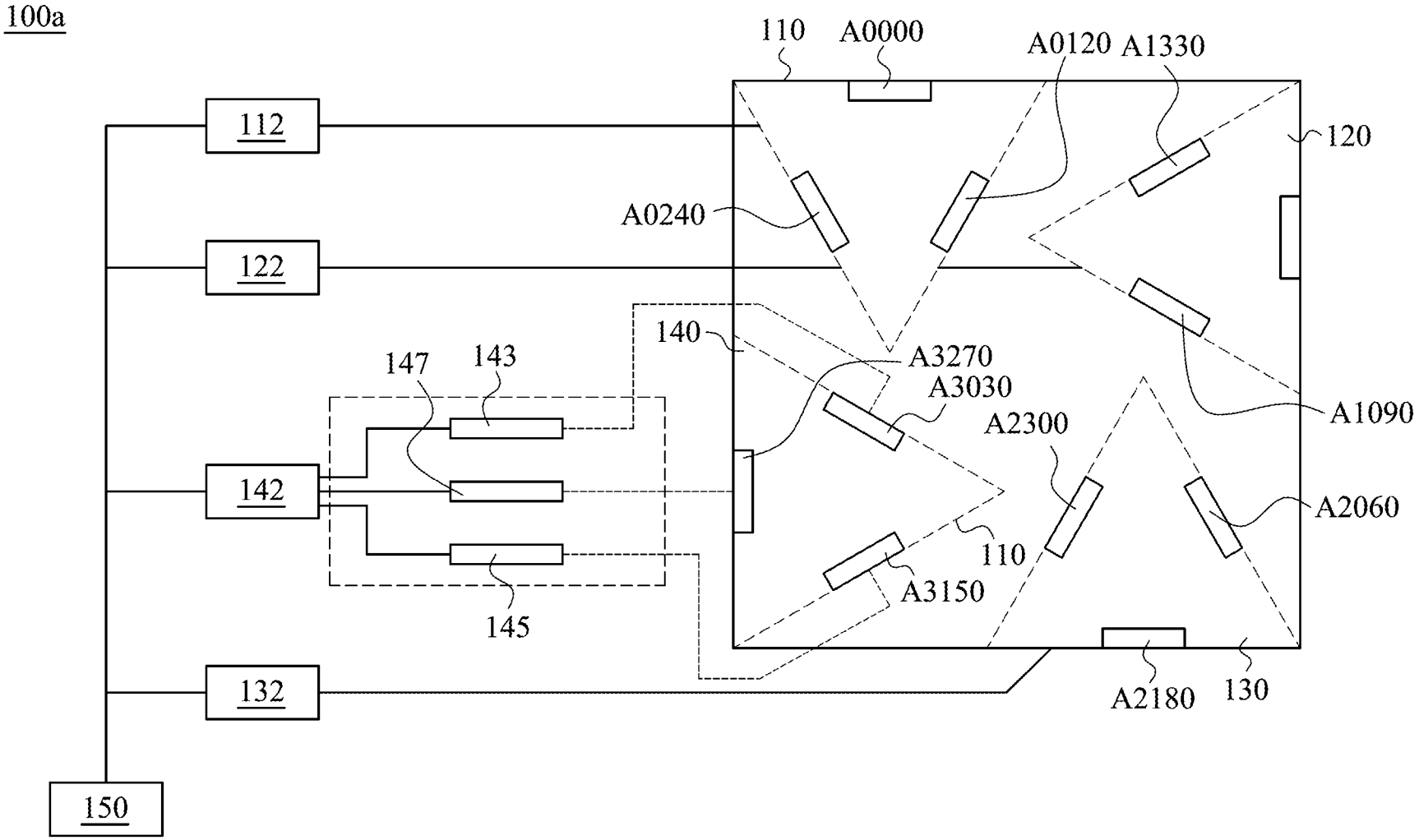
FIG. 1A is a block diagram of an antenna array system according to one embodiment of the present disclosure.

Reference will now be made in detail to the present embodiments of the invention, examples of which are illustrated in the accompanying drawings. Wherever possible, the same reference numbers are used in the drawings and the description to refer to the same or like parts.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about", "substantially" or "approximately" can be inferred if not expressly stated.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

FIG. 1A is a block diagram of an antenna array system 100*a* according to one embodiment of the present disclosure. As shown in FIG. 1A, the antenna array system 100*a* includes a plurality of antenna array units 110, 120, 130 and 140, and a processor 150. Base on this structure, the processor 150 is electrically connected to the antenna array units 110, 120, 130 and 140. The antenna array units 110, 120, 130 and 140 are evenly arranged with different orientations. Specifically, in FIG. 1A, the different azimuth angle of any adjacent two of the antenna array units 110, 120, 130 and 140 is 90 degrees, and the antenna array units 110, 120, 130 and 140 are equidistantly arranged in an around arrangement.

In practice, each antenna array unit includes a plurality of antenna elements with different azimuth angles. As shown in FIG. 1A, the antenna array unit 110 includes an antenna element A0000 with an azimuth angle 0 degree, an antenna element A0120 with an azimuth angle 120 degrees, and an antenna element A0240 with an azimuth angle 240 degrees. The antenna array unit 120 includes an antenna element A1090 with an azimuth angle 90 degrees, an antenna element A1210 with an azimuth angle 210 degrees, and an antenna element A1330 with an azimuth angle 330 degrees. The antenna array unit 130 includes an antenna element A2180 with an azimuth angle 180 degrees, an antenna element A2300 with an azimuth angle 300 degrees, and an antenna element A2060 with an azimuth angle 60 degrees. The antenna array unit 140 includes an antenna element A3270 with an azimuth angle 270 degrees, an antenna element A3030 with an azimuth angle 30 degrees, and an antenna element A3150 with an azimuth angle 150 degrees. It should be noted that the azimuth angle can be obtained by each antenna unit with respect to a reference azimuth angle as a reference for the layout. For example, in the embodiment, the antenna element A0000 is used as the reference for the reference azimuth angle.

In one embodiment, each azimuthal difference between any adjacent two of the antenna elements in the each antenna array unit is identical in value. Specifically, in the antenna array unit 110, the azimuthal difference between the antenna element A0000 and the antenna element A0120 is 120 degrees, the azimuthal difference between the antenna element A0120 and the antenna element A0240 is 120 degrees, and the azimuthal difference between the antenna element A0240 and the antenna element A0000 is 120 degrees. The azimuthal difference between any adjacent two antenna elements in any other antenna array unit is 120 degrees, and the present disclosure is not repeated herein.

In one embodiment, each azimuthal difference between two corresponding antenna elements of any adjacent two of the antenna array units is identical in value. Specifically, the azimuthal difference between the antenna element A0000 of the antenna array unit 110 and the antenna element A1090 of the antenna array unit 120 is 90 degrees, the azimuthal difference between the antenna element A0120 of the antenna array unit 110 and the antenna element A1210 of the antenna array unit 120 is 90 degrees, and the azimuthal difference between the antenna element A0240 of the antenna array unit 110 and the antenna element A1330 of the antenna array unit 120 is 90 degrees.

In one embodiment, the antenna array unit 110 is electrically connected to the wireless transceiver unit 112, and the wireless transceiver unit 112 is electrically connected to the processor 150. The antenna array unit 120 is electrically connected to the wireless transceiver unit 122, and the wireless transceiver unit 122 is electrically connected to the processor 150. The antenna array unit 130 is electrically connected to the wireless transceiver unit 132, and the wireless transceiver unit 132 is electrically connected to the processor 150. The antenna array unit 140 is electrically connected to the wireless transceiver unit 142, and the wireless transceiver unit 142 is electrically connected to the processor 150.

Moreover, in one embodiment, the antenna array unit 140 is electrically connected to the wireless transceiver unit 142 through a switch unit. The switch units 147, 142 and 145 are electrically connected to the antenna elements A3270, A3030 and A3150 respectively. In real operation, the processor 150 or other device can switch the switch units 147, 142 and 145. The switch units 147, 142 and 145 are configured to turn on or off the antenna elements A3270, A3030 and A3150. FIG. 1A illustrates three switch units 147, 142 and 145 for concisely illustrative purpose only. In practice, the other antenna elements and wireless transceiver units can be electrically connected to the corresponding switch units. Those with ordinary skill in the art may flexibly design the switch units depending on the desired application.

Figure 1B:
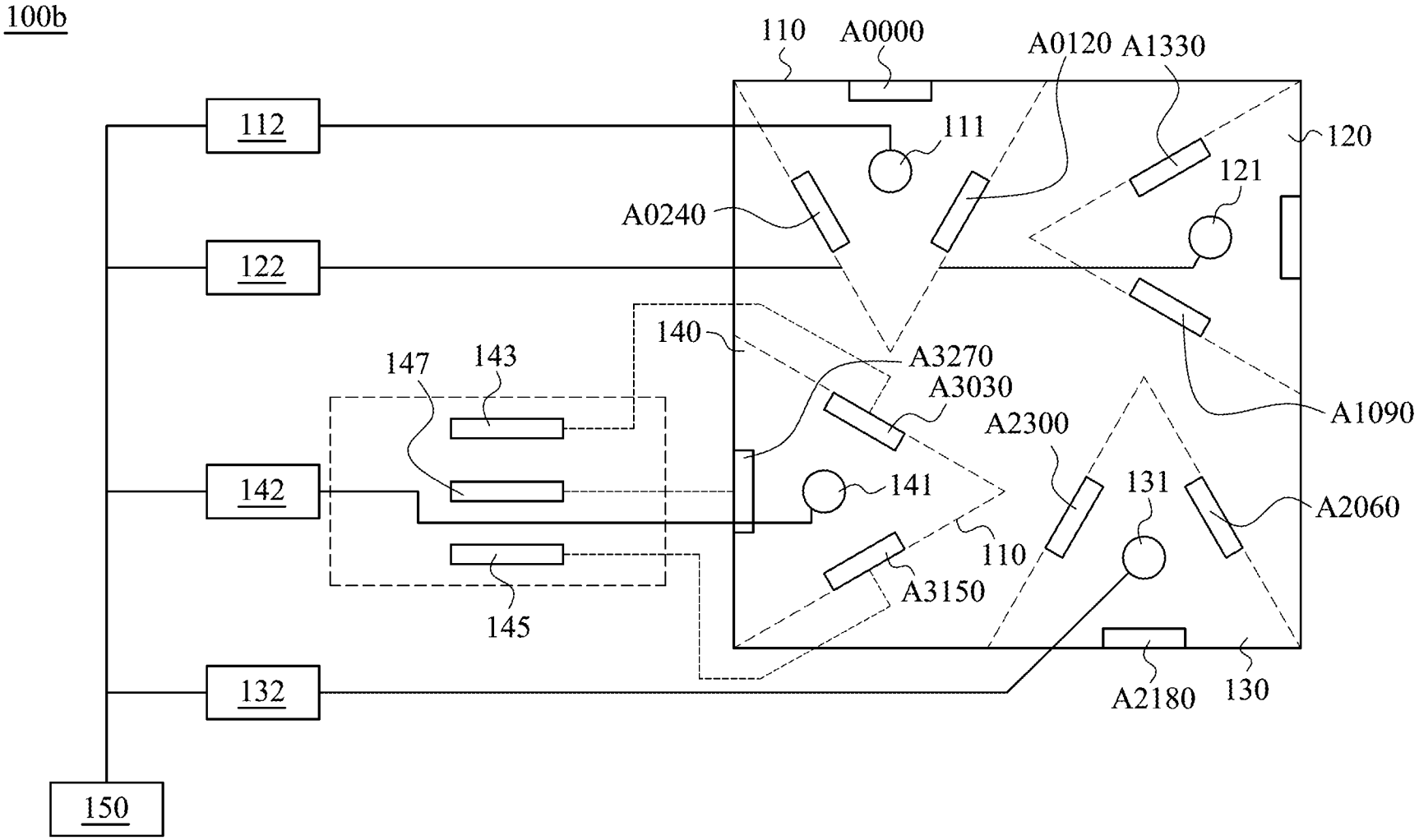
FIG. 1B is a block diagram of an antenna array system according to another embodiment of the present disclosure.

FIG. 1B is a block diagram of an antenna array system according to another embodiment of the present disclosure. The difference between FIG. 1B and FIG. 1A is that the antenna array unit 110 further includes a main antenna element 111 as a main antenna or a driving antenna, and the antenna elements A0000, A0120 and A0240 is a passive antenna or a parasitic antenna. The main antenna element 111 is electrically connected to the wireless transceiver unit 112, and the wireless transceiver unit 112 is electrically connected to the processor 150.

Similarly, the antenna array unit 120 further includes a main antenna element 121 as a main antenna, and the antenna elements A1090, A1210 and A1330 is a parasitic antenna. The main antenna element 121 is electrically connected to the wireless transceiver unit 122, and the wireless transceiver unit 122 is electrically connected to the processor 150.

Similarly, the antenna array unit 130 further includes a main antenna element 131 as a main antenna, and the antenna elements A2180, A2300 and A2060 is a parasitic antenna. The main antenna element 131 is electrically connected to the wireless transceiver unit 132, and the wireless transceiver unit 132 is electrically connected to the processor 150.

Similarly, the antenna array unit 140 further includes a main antenna element 141 as a main antenna, and the antenna elements A3270, A3030 and A3150 is a parasitic antenna. The main antenna element 141 is electrically connected to the wireless transceiver unit 142, and the wireless transceiver unit 142 is electrically connected to the processor 150.

Similarly, in one embodiment, each parasitic antenna of each antenna array unit can be electrically connected to the wireless transceiver unit through a switch unit as mentioned above, and thus, the present disclosure is not repeated herein.

In one embodiment, the different azimuth angles of the antenna elements in the each antenna array unit form a vector. The antenna elements A0000, A0120 and A0240 of the antenna array unit 110 correspond to a vector (000, 120, 240). The antenna elements A1090, A1210 and A1330 of the antenna array unit 120 correspond to a vector (090, 210, 330). The antenna elements A2180, A2300 and A2060 of the antenna array unit 130 correspond to a vector (180, 300, 060). The antenna elements A3270, A3030 and A3150 of the antenna array unit 140 correspond to a vector (270, 030, 150).

The vectors correspond to the antenna array units 110, 120, 130 and 140 constitute a vector matrix as follows.

$$\begin{bmatrix} [000, 120, 240] & [090, 210, 330] \\ [270, 030, 150] & [180, 300, 060] \end{bmatrix}$$

In above 2×2 vector matrix, vector heads (i.e., a first vector component) of the vectors constitute a head matrix as follows.

$$\begin{bmatrix} 0 & 90 \\ 270 & 180 \end{bmatrix}$$

The above head matrix based on the vector heads matches a predetermined rule. Specifically, the number of the antenna array units 110, 120, 130 and 140 is four, the vectors is four sets of the vectors, and the vector matrix is a 2×2 vector matrix, and the predetermined rule comprises that each difference between two vector heads of any two adjacent vectors of the four sets of the vectors is identical in value. For example, the vector head of the vector (000, 120, 240) is 000 corresponding to 360, and the vector head of the vector (270, 030, 150) is 270, where 360−270=90. The vector head of the vector (270, 030, 150) is 270, and the vector head of the vector (180, 300, 060) is 180, where 270−180=90. The vector head of the vector (180, 300, 060) is 180, and the vector head of the vector (090, 210, 330) is 90, where 180−90=90. The vector head of the vector (090, 210, 330) is 90, and the vector head of the vector (000, 120, 240) is 000, where 90−0=90.

Figure 2:
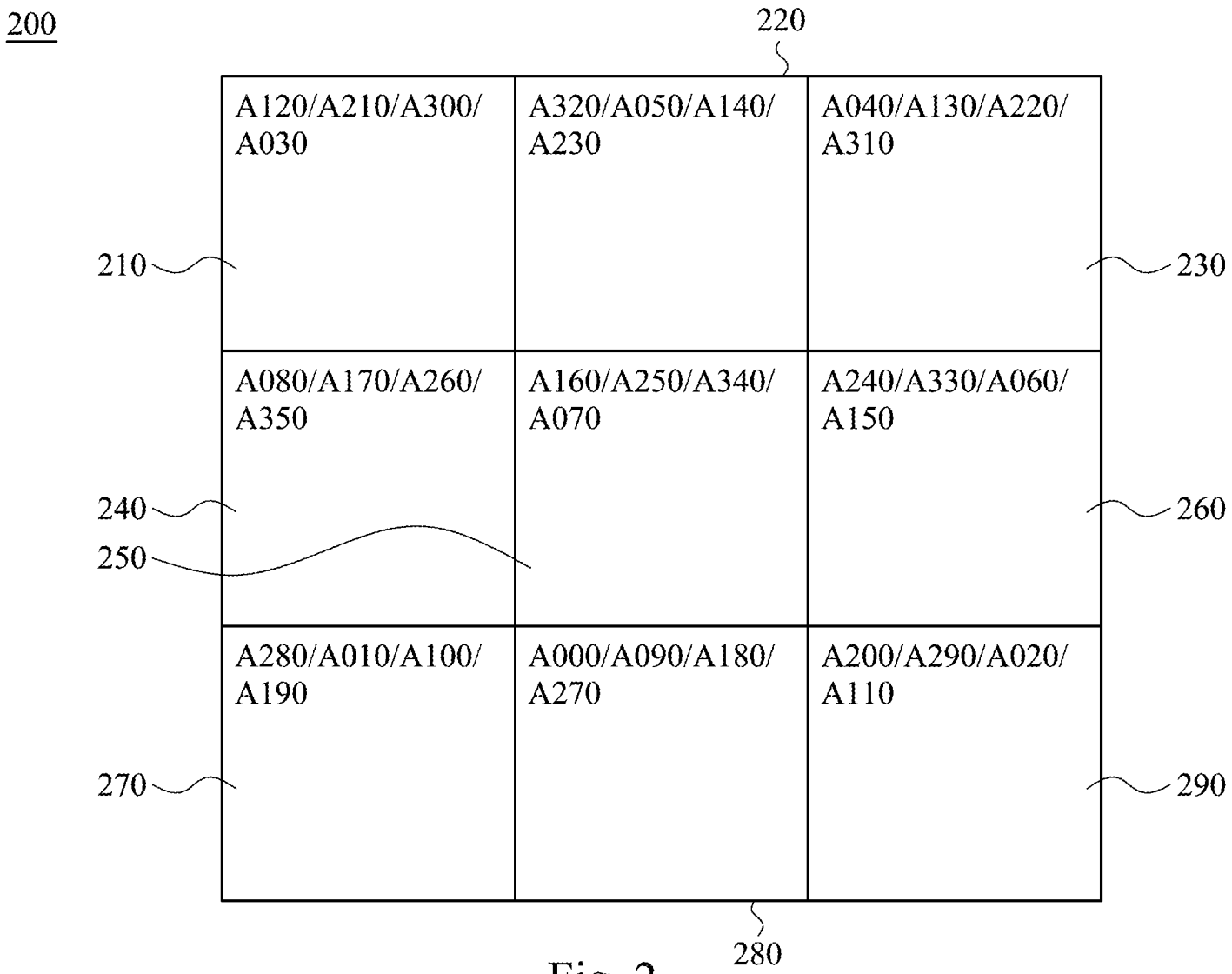
FIG. 2 is a schematic diagram of an antenna array system according to one embodiment of the present disclosure.

FIG. 2 is a schematic diagram of an antenna array system 200 according to one embodiment of the present disclosure. As shown in FIG. 2, the antenna array unit 210 includes antenna elements A120, A210, A300 and A030. The antenna array unit 220 includes antenna elements A320, A050, A140 and A230. The antenna array unit 230 includes antenna elements A040, A130, A220 and A310. The antenna array unit 240 includes antenna elements A080, A170, A260 and A350. The antenna array unit 250 includes antenna elements A160, A250, A340 and A070. The antenna array unit 260 includes antenna elements A240, A330, A060 and A150. The antenna array unit 270 includes antenna elements A280, A010, A100 and A190. The antenna array unit 280 includes antenna elements A000, A090, A180 and A270. The antenna array unit 290 includes antenna elements A200, A290, A020 and A110. FIG. 2 does not illustrate a processor and so forth for concisely illustrative purpose only. In practice, the antenna array unit 210, 220, 230, 240, 250, 260, 270, 280 and 290 are electrically connected to the processor and so forth (e.g., the processor 150 in FIG. 1A).

In the antenna array system 200, the number of the antenna array units 210, 220, 230, 240, 250, 260, 270, 280 and 290 is nine, the vectors is nine sets of the vectors, the vector matrix of the nine sets of the vectors is a 3×3 vector matrix as follows.

$$\begin{bmatrix} [120, 210, 300, 030] & [320, 050, 140, 230] & [040, 130, 220, 310] \\ [080, 170, 260, 350] & [160, 250, 340, 070] & [240, 330, 060, 150] \\ [280, 010, 100, 190] & [000, 090, 180, 270] & [200, 290, 020, 110] \end{bmatrix}$$

The above 3×3 vector matrix matches the predetermined rule. In the antenna array system 200, the antenna array units are evenly arranged in different orientations and are equidistantly arranged in an around arrangement. Each azimuthal difference between any adjacent two of the antenna elements in the each antenna array unit is identical in value. Each azimuthal difference between two corresponding antenna elements of any adjacent two of the antenna array units is identical in value. Compared with the 2×2 vector matrix, the 3×3 vector matrix matches "magic square" included in the predetermined rule that includes that the sum of each row, column and diagonal of RMS (Root mean square) values of the vectors in the vector matrix is substantially equal. For an example, the RMS values of the vectors constitute a 3×3 RMS matrix as follows.

$$\begin{bmatrix} 548.3 & 932.0 & 403.7 \\ 474.8 & 623.4 & 776.5 \\ 854.0 & 336.7 & 699.6 \end{bmatrix}$$

The sum of each row, column and diagonal of the above 3×3 RMS matrix is described as follows.

548.3+932.0+403.7=1884

474.8+623.4+776.5=1875

854.0+336.7+699.6=1890

548.3+474.8+854.0=1877

932.0+623.4+336.7=1892

403.7+776.5+699.6=1880

548.3+623.4+699.6=1872

403.7+623.4+854.0=1881

In view of the above, the sum of each row, column and diagonal of RMS values of the vectors is substantially equal. Accordingly, the above 3×3 RMS matrix matches the magic square.

As to the magic square, for another example, the vector heads (i.e., a first vector component) of the 3×3 vector matrix constitute a head matrix as follows.

$$\begin{bmatrix} 120 & 320 & 040 \\ 080 & 160 & 240 \\ 280 & 000 & 200 \end{bmatrix}$$

The sum of each row, column and diagonal of the above 3×3 head matrix based on the vector heads is described as follows.

120+320+040=480

080+160+240=480

280+000+200=480

120+080+280=480

320+160+000=480

040+240+200=480

120+160+200=480

040+160+280=480

Accordingly, the sum of each row, column and diagonal of the above 3×3 matrix based on the vector heads is equal (i.e., 480). The above 3×3 matrix based on the vector heads matches the magic square.

For yet another example, the above 3×3 matrix based on the vector heads can be further simplified as a 3×3 index matrix. The 3×3 index matrix includes index integers, where the order of the index integers depends on the magnitude of the vector heads. The 3×3 index matrix is described as follows.

$$\begin{bmatrix} 4 & 9 & 2 \\ 3 & 5 & 7 \\ 8 & 1 & 6 \end{bmatrix}$$

The sum of each row, column and diagonal of index integers of vector heads is described as follows.

4+9+2=15

3+5+7=15

8+1+6=15

4+3+8=15

9+5+1=15

2+7+6=15

4+5+6=15

2+5+8=15

Accordingly, the sum of each row, column and diagonal of the 3×3 index matrix is equal (i.e., 15). The above 3×3 index matrix matches the magic square.

In view of the above, the 3×3 vector matrix is on the basis of the magic square, and rows and columns of the 3×3 vector matrix have a plurality of azimuth clustered sets respectively as the following table.

| | R1 | R2 | R3 | C1 | C2 | C3 | D1 | D2 |
|---|---|---|---|---|---|---|---|---|
| 0 | | | 0 | | 0 | | | |
| 10 | | | 10 | 10 | | | | 10 |
| 20 | | | 20 | | | 20 | 20 | |
| 30 | 30 | | | 30 | | | 30 | |
| 40 | 40 | | | | | 40 | | 40 |
| 50 | 50 | | | | 50 | | | |
| 60 | | 60 | | | | 60 | | |
| 70 | | 70 | | | 70 | | 70 | 70 |
| 80 | | 80 | | 80 | | | | |
| 90 | | | 90 | | 90 | | | |
| 100 | | | 100 | 100 | | | | 100 |
| 110 | | | 110 | | | 110 | 110 | |
| 120 | 120 | | | 120 | | | 120 | |
| 130 | 130 | | | | | 130 | | 130 |
| 140 | 140 | | | | 140 | | | |
| 150 | | 150 | | | | 150 | | |
| 160 | | 160 | | | 160 | | 160 | 160 |
| 170 | | 170 | | 170 | | | | |
| 180 | | | 180 | | 180 | | | |
| 190 | | | 190 | 190 | | | | 190 |
| 200 | | | 200 | | | 200 | 200 | |
| 210 | 210 | | | 210 | | | 210 | |
| 220 | 220 | | | | | 220 | | 220 |
| 230 | 230 | | | | 230 | | | |
| 240 | | 240 | | | | 240 | | |
| 250 | | 250 | | | 250 | | 250 | 250 |
| 260 | | 260 | | 260 | | | | |

-continued

| | R1 | R2 | R3 | C1 | C2 | C3 | D1 | D2 |
|---|---|---|---|---|---|---|---|---|
| 270 | | | 270 | | 270 | | | |
| 280 | | | 280 | 280 | | | | 280 |
| 290 | | | 290 | | | 290 | 290 | |
| 300 | 300 | | | 300 | | | 300 | |
| 310 | 310 | | | | | 310 | | 310 |
| 320 | 320 | | | | 320 | | | |
| 330 | | 330 | | | | 330 | | |
| 340 | | 340 | | | 340 | | 340 | 340 |
| 350 | | 350 | | 350 | | | | |

In view of the above table, in the 3×3 vector matrix based on the magic square, a first row R1 has an azimuth clustered set of 30, 40 and 50 degrees, an azimuth clustered set of 120, 130 and 140 degrees, and an azimuth clustered set of 300, 310 and 320 degrees.

Similarly, in the 3×3 vector matrix based on the magic square, a second row R2, a third row R3, a first column C1, a second column C2, a third column C3, a first diagonal D1 and second diagonal D2 have respective azimuth clustered sets as described in the above table, and thus are not repeated herein.

Figure 3:
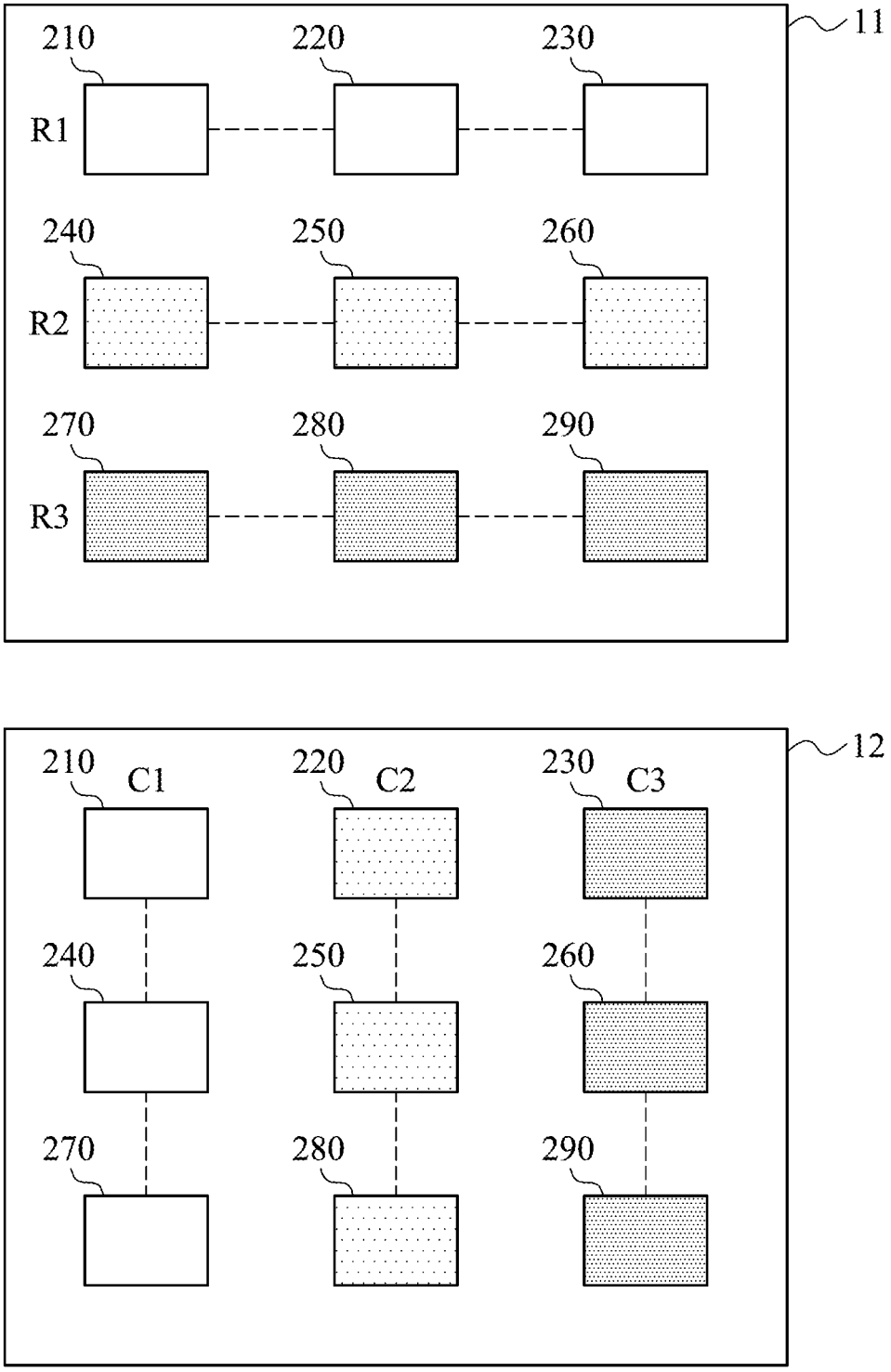
FIG. 3 is a schematic diagram of aggregated groups according to one embodiment of the present disclosure.

FIG. 3 is a schematic diagram of aggregated groups 11 and 12 according to one embodiment of the present disclosure. As shown in FIGS. 2 and 3, in the aggregated group 11, the azimuth clustered set of 30, 40 and 50 degrees of the first row R1 corresponds to a set of antenna elements A030, A040 and A050 electrically connected to each other, so as to facilitate operation by the processor (e.g., the processor 150 in FIG. 1A), where the antenna element A030 is selected from the antenna array unit 210, the antenna element A040 is selected from the antenna array unit 230, and the antenna element A050 is selected from the antenna array unit 220. Similarly, the azimuth clustered set of 120, 130 and 140 degrees of the first row R1 corresponds to a set of antenna elements A120, A130 and A140 electrically connected to each other. The azimuth clustered set of 300, 310 and 320 degrees of the first row R1 corresponds to a set of antenna elements A300, A310 and A320 electrically connected to each other.

Similarly, the second row R2 and the third row R3 in the aggregated group 11, and the first column C1, the second column C2, and the third column C3 in the aggregated group 12 correspond to respective sets of antenna elements, and thus are not repeated herein.

Figure 4:
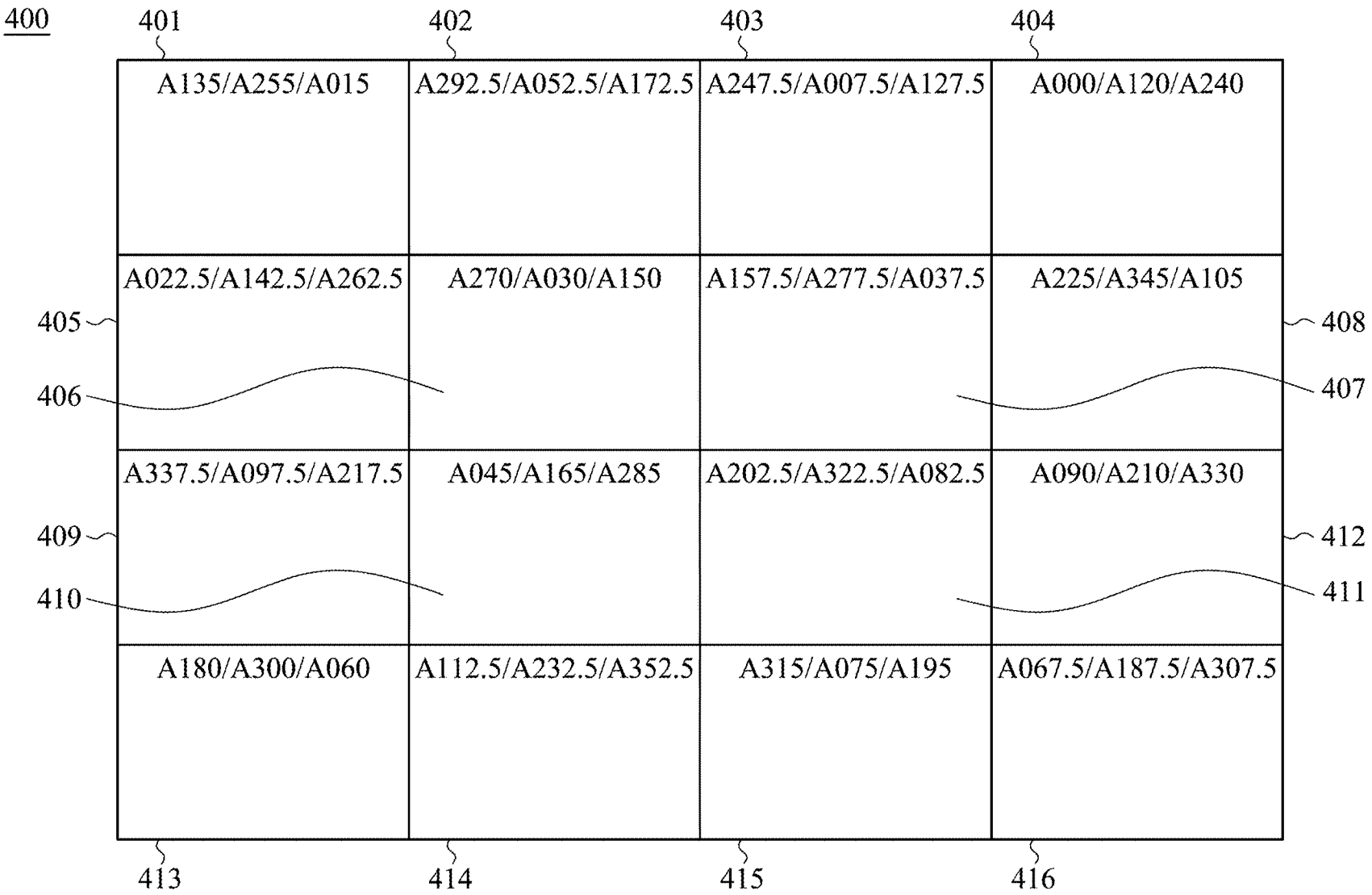
FIG. 4 is a schematic diagram of an antenna array system according to one embodiment of the present disclosure.

FIG. 4 is a schematic diagram of an antenna array system 400 according to one embodiment of the present disclosure. As shown in FIG. 4, the antenna array unit 401 includes antenna elements A135, A255 and A015. The antenna array unit 402 includes antenna elements A247.5, A007.5 and A127.5. The antenna array unit 403 includes antenna elements A000, A120 and A240. The antenna array unit 404 includes antenna elements A292.5, A052.5 and A172.5. The antenna array unit 405 includes antenna elements A022.5, A142.5 and A262.5. The antenna array unit 406 includes antenna elements A270, A030 and A150. The antenna array unit 407 includes antenna elements A157.5, A277.5 and A037.5. The antenna array unit 408 includes antenna elements A225, A345 and A105. The antenna array unit 409 includes antenna elements A337.5, A097.5 and A217.5. The antenna array unit 410 includes antenna elements A045, A165 and A285. The antenna array unit 411 includes antenna elements A202.5, A322.5 and A082.5. The antenna array unit 412 includes antenna elements A090, A210 and A330. The antenna array unit 413 includes antenna elements A180, A300 and A060. The antenna array unit 414 includes antenna elements A112.5, A232.5 and A352.5. The antenna array unit 415 includes antenna elements A315, A075 and A195. The antenna array unit 416 includes antenna elements A067.5, A187.5 and A307.5.

In the antenna array system 400, the number of the antenna array units 401-416 is sixteen, the vectors is sixteen sets of the vectors, the vector matrix of the sixteen sets of the vectors is a 4×4 vector matrix that matches the above-mentioned arrangement. In the antenna array system 400, the antenna array units are evenly arranged in different orientations and are equidistantly arranged in an around arrangement. Each azimuthal difference between any adjacent two of the antenna elements in the each antenna array unit is identical in value. Each azimuthal difference between two corresponding antenna elements of any adjacent two of the antenna array units is identical in value. The mathematical deduction process and the vector clustering effect of the magic square of the 4×4 vector matrix are similar to that of the 3×3 vector matrix. The RMS values of the vectors constitute a 4×4 RMS matrix, a 4×4 head matrix based on the vector heads (i.e., a first vector component), and a 4×4 index matrix simplified from the 4×4 head matrix are described as follows, where the order of the index integers depends on the magnitude of the vector heads.

$$\begin{bmatrix} 473.2 & 658.8 & 268.3 & 734.3 \\ 299.5 & 696.5 & 209.7 & 621.2 \\ 810.4 & 332.4 & 583.8 & 401.4 \\ 546.6 & 437.0 & 772.3 & 366.4 \end{bmatrix}$$

$$\begin{bmatrix} 135 & 247.5 & 0 & 292.5 \\ 22.5 & 270 & 157.5 & 225 \\ 337.5 & 45 & 202.5 & 90 \\ 180 & 112.5 & 315 & 67.5 \end{bmatrix}$$

$$\begin{bmatrix} 7 & 12 & 1 & 14 \\ 2 & 13 & 8 & 11 \\ 16 & 3 & 10 & 5 \\ 9 & 6 & 15 & 4 \end{bmatrix}$$

Accordingly, the sum of each row, column and diagonal of values of the vectors is substantially equal. The sum of each row, column and diagonal of the vector heads is equal (i.e., 675). For example, the sum of a first row of the vector heads is 135+247.5+0+292.5=675, the sum of a first column of the vector heads is 135+22.5+337.5+180=675, the sum of a first diagonal of the vector heads is 292.5+157.5+45+180=675, and the other can be calculated in the same manner. The sum of each row, column and diagonal of the index integers is equal (i.e., 34). For example, the sum of a first row of the index integers is 7+12+1+14=34, the sum of a first column of the index integers is 7+2+16+9=34, the sum of a first diagonal of the index integers is 14+8+3+9=34, and the other can be calculated in the same manner. Rows and columns of the 4×4 vector matrix have a plurality of azimuth clustered sets respectively as above mentioned embodiments, and thus are not repeated herein.

It should be understood that the above 3×3 or 4×4 vector matrix based on the magic square is merely an example and is not intended to limit the present disclosure. In practice, those skilled in the art can flexibly increase or decrease the antenna array units to form the antenna array system depending on the desired application.

Figure 5:
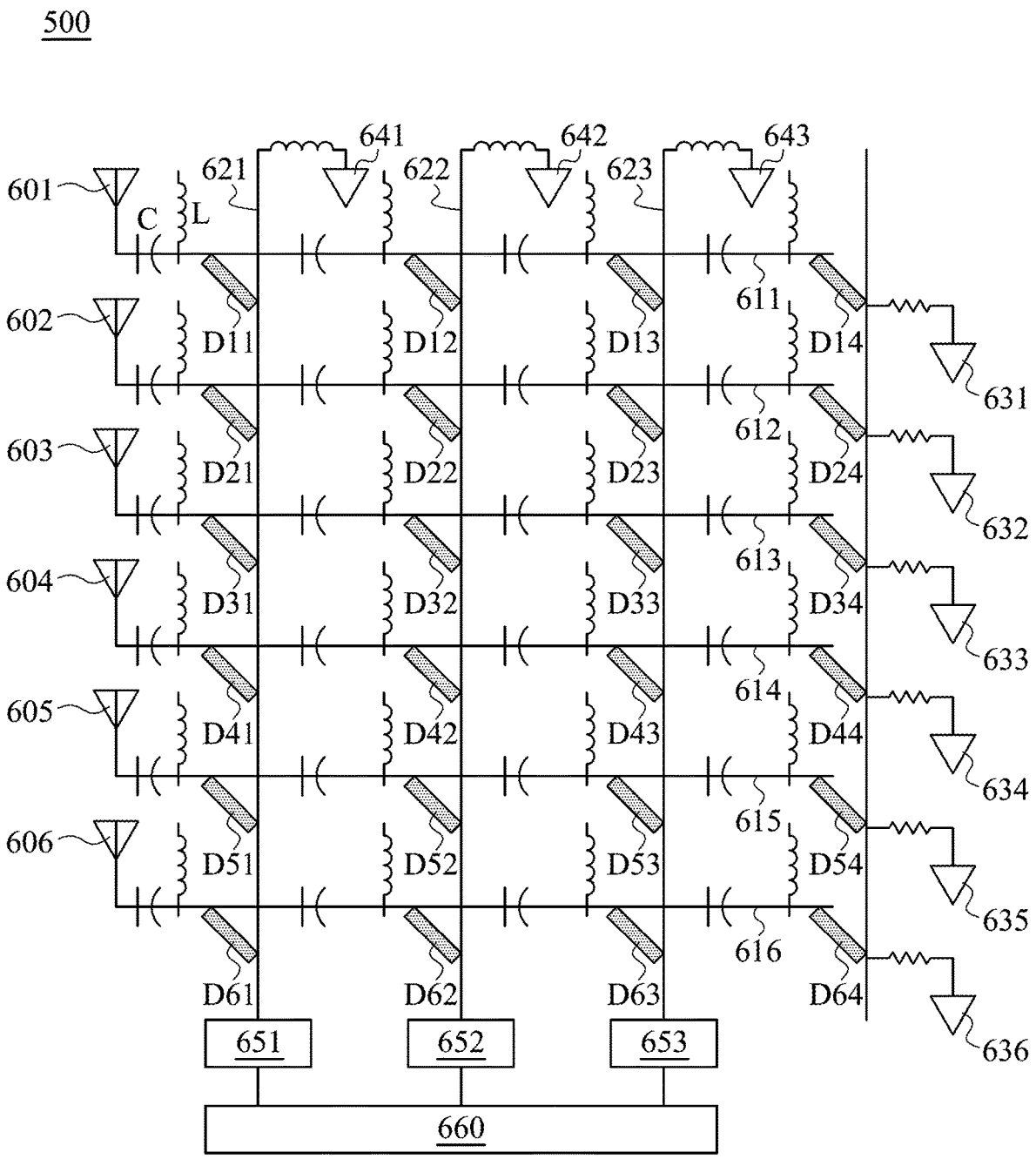
FIG. 5 is a circuit diagram of an antenna array system according to one embodiment of the present disclosure.

If it is necessary to expand the coverage space, the foregoing plurality of antenna arrays may connect antennas that correspond to a plurality of positions by a way of diversity and according to the circuit chart of the antenna array system 500 of FIG. 5 according to one embodiment of the present disclosure. In this embodiment, the number of the circuits is equal to the number of the antennas. As shown in FIG. 5, the antenna array system 500 includes a processor 660, a plurality of antenna array units 601-606, a plurality of virtual loads 631-636, a plurality of wireless transceivers 651-653, first conducting wires 611-616, and second conducting wires 621-623. The second conducting wires 621-623 are interlaced with the first conducting wires 611-616. The wireless transceiver units 651-653 are electrically connected to the processor 660. Two ends of each of the first conducting wires 611-616 are electrically connected to a corresponding one of antenna array units 601-606 and a corresponding one of virtual loads 631-636. Two ends of each of the second conducting wires 621-623 are electrically connected to a corresponding one of the wireless transceiver units 651-653 and grounds 641-643.

In one embodiment, the antenna array system 500 further includes electronic switches D11-D14, D21-D24, D31-D34, D41-D44, D51-D54, and D61-D64. Each of the electronic switches is electrically connected to the corresponding one of the first conducting wires and the corresponding one of the second conducting wires. For example, the electronic switch D11 electrically connected to the first conducting wire 611 and the second conducting wire 621. The connections of other electronic switches are shown in FIG. 5, and thus are not repeated herein.

Specifically, the each of the electronic switches is a diode, an anode of the diode is electrically connected to the corresponding one of the first conducting wires, and a cathode of the diode is electrically connected to the corresponding one of the second conducting wires. For example, the electronic switch D11 is a diode, the anode of the diode is electrically connected to the first conducting wire 611, and the cathode of the diode is electrically connected to the second conducting wire 621. The connections of diodes are shown in FIG. 5, and thus are not repeated herein.

In addition, the antenna array system 500 further includes capacitors C and inductors L. The capacitors C are configured to filter low frequency noise, and the inductors L are configured to filter high frequency noise.

In practice, the antenna array arrangement as shown in FIGS. 1A to 4 can be applied to the circuit architecture as shown in FIG. 5, and the diode switch can greatly reduce the number of conventional switches, and facilitate control.

In view of above, the antenna array system of the present disclosure can improve the diversity of angles of the antennas. Furthermore, in the antenna array based on the magic square, the different azimuth clusters form antenna azimuths evenly interlaced for convenient control.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna array system comprising:

a plurality of antenna array units evenly arranged in different orientations, wherein each antenna array unit comprises a main antenna element and a plurality of antenna elements with different azimuth angles, and the different azimuth angles of the antenna elements in the each antenna array unit form a vector, wherein the vectors corresponding to the antenna array units constitute a vector matrix that matches a predetermined rule;

a processor electrically connected to the antenna array units;

a plurality of wireless transceivers units electrically connected to the processor, wherein the main antenna elements are directly connected to the wireless transceiver units; and a plurality of switch units, wherein the antenna elements are connected to the wireless transceiver units through the switch units.

2. The antenna array system of claim 1, wherein each azimuthal difference between any adjacent two of the antenna elements in the each antenna array unit is identical in value, and each azimuthal difference between two corresponding antenna elements of any adjacent two of the antenna array units is identical in value.

3. The antenna array system of claim 2, wherein the number of the antenna array units is four, the vectors is four sets of the vectors, and the vector matrix is a 2×2 vector matrix, and the predetermined rule comprises that each difference between two vector heads of any two adjacent vectors of the four sets of the vectors is identical in value.

4. The antenna array system of claim 2, wherein the number of the antenna array units is nine or sixteen, the vectors is nine sets of the vectors when the number of the antenna array units is nine, the vectors is sixteen sets of the vectors when the number of the antenna array units is sixteen, the vector matrix of the nine sets of the vectors is a 3×3 vector matrix, the vector matrix of the sixteen sets of the vectors is a 4×4 vector matrix, the predetermined rule comprises that the sum of each row, column and diagonal of RMS (Root mean square) values of the vectors in the vector matrix is substantially equal.

5. The antenna array system of claim 4, wherein vector heads are selected from the vectors in the vector matrix to constitute a head matrix, and the predetermined rule comprises that the sum of each row, column and diagonal of values of the head matrix is substantially equal.

6. The antenna array system of claim 4, wherein vector heads are selected from the vectors in the vector matrix as selected values to constitute a head matrix, the selected values of the head matrix are simplified to be index integers of an index matrix, order of the index integers depends on the magnitude of the selected values, and the predetermined rule comprises that the sum of each row, column and diagonal of values of index integers of the index matrix is substantially equal.

7. The antenna array system of claim 4, wherein the 3×3 vector matrix matches the predetermined rule, any row and any column of the 3×3 vector matrix have a plurality of azimuth clustered sets respectively, each azimuth clustered set corresponds to a set of antenna elements, and the set of antenna elements are electrically connected to each other, so as to facilitate operation by the processor.

8. The antenna array system of claim 2, further comprising:

a plurality of virtual loads;

a plurality of first conducting wires, wherein two ends of each of the first conducting wires are electrically connected to a corresponding one of antenna array units and a corresponding one of virtual loads; and a plurality of second conducting wires are interlaced with the first conducting wires, wherein two ends of each of the second conducting wires are electrically connected to a corresponding one of the wireless transceiver units and a ground.

9. The antenna array system of claim 8, further comprising:

a plurality of electronic switches, each of the electronic switches electrically connected to the corresponding one of the first conducting wires and the corresponding one of the second conducting wires.

10. The antenna array system of claim 9, wherein the each of the electronic switches is a diode, an anode of the diode is electrically connected to the corresponding one of the first conducting wires, and a cathode of the diode is electrically connected to the corresponding one of the second conducting wires.

* * * * *